United States Patent [19]

West

[11] 4,393,528

[45] Jul. 19, 1983

[54] ADJUSTABLE TRAMPOLINE TYPE POOL AND HOT TUB COVER

[76] Inventor: Trent W. West, P.O. Box 956, Aptos, Calif. 95003

[21] Appl. No.: 259,414

[22] Filed: May 1, 1981

[51] Int. Cl.[3] ..... E04H 3/16

[52] U.S. Cl. ..... 4/498

[58] Field of Search ..... 4/494, 498, 499, 503; 126/415; 220/332, 333, 336, 216, 218, 220, 226

[56] References Cited

U.S. PATENT DOCUMENTS

| | | | |
|---|---|---|---|
| 439,148 | 10/1890 | Hayden | 220/336 |
| 1,487,518 | 3/1924 | Nichols et al. | 220/336 X |
| 1,753,990 | 4/1930 | Kohlman | 220/332 |
| 2,870,455 | 1/1959 | Reeves | 4/498 |
| 2,912,703 | 11/1959 | Murphy | 4/494 |
| 3,541,615 | 11/1970 | Myrtha | 4/503 |
| 3,724,704 | 4/1973 | Edwards et al. | 220/226 |
| 3,815,775 | 6/1974 | Strune et al. | 220/220 |
| 3,895,400 | 7/1975 | Kelcey | 4/494 |
| 4,078,293 | 3/1978 | Aine | 4/498 X |
| 4,139,117 | 2/1979 | Dial | 4/499 X |

*Primary Examiner*—Charles E. Phillips

*Attorney, Agent, or Firm*—Christie, Parker & Hale

[57] ABSTRACT

A cover for covering pools having a pool coping elevated a predetermined height above the surface area surrounding the pool. A pair of spaced apart hinges are mounted to a rigid support adjacent the pool. A hinge arm is pivotally mounted in each hinge for pivoting about a pivot axis. Each arm is capable of rotation through a predetermined angle of rotation from a plane that is substantiallay normal to the pivot axis. Each hinge arm includes a clamp within which a rigid planar hoop that circumscribes the pool is secured. The hinge arm has an axis and the clamp has an axis oriented a predetermined clamp angle away from the axis of the arm. A panel spanning the central interior area of the hoop is secured to the hoop. The clamp angle and the angle of rotation in combination allow for adjustment of the hoop in the clamp in accordance with the shape of said hoop and the presence and elevation of the pool coping such that when the panel covers the pool, the hoop lies in a horizontal plane. A resilient seal is attached to the one side of the panel for forming an airtight seal with the panel such that when the panel covers the pool, the resilient seal contacts the surface area surrounding the pool for providing a substantially airtight seal between the pool and the region enclosed by the cover.

17 Claims, 13 Drawing Figures

ADJUSTABLE TRAMPOLINE TYPE POOL AND HOT TUB COVER

BACKGROUND OF THE INVENTION

This invention relates to a pool cover that has hinges capable of being adjusted to various sized pools. The cover is also capable of covering pools having a pool coping that surrounds the pool and extends upward from the area surrounding the pool. The advantage and usefulness of a pool cover is well recognized. Covers for pools, hot tubs, jacuzzi and the like may be employed to prevent debris such as dust, leaves, insects etc., from entering the pool during periods of non-use. Additionally, covers may be employed to inhibit the evaporation of water from the pool and to maintain elevated temperatures in the pool for purposes of minimizing heating costs. Pool covers also serve as a safety factor to prevent entrance of small unattended children into the pool.

To this end, pool covers have been provided for covering pools during periods of non-use. Typically, the pool covers have canopies that provide a sun shade during pool usage and cover the pool during periods of non-use. The canopies typically have an associated frame work. One such device is described by Mishke in U.S. Pat. No. 3,854,149. Mishke shows a sun canopy convertable to a swimming pool cover. In the sun canopy mode, a horizontal rectangular roof portion is hinged at its back edge to the top edge of a vertical back portion which is, in turn, pivotally attached at each bottom corner to a base rod which extends forwardly from each corner long the ground perpendicular to the back portion. The forwardly extending end of each rod is secured to the ground in a manner permitting the rod to rotate about its ground attachment point in a vertical plane. In converting the canopy to a pool cover, the base rods pivot about the ground securing points permitting the back portion to rotate up and over the ground securing points until it is over the pool. Since the roof portion is hinged to the back portion which is in turn hinged to the base rods, the roof and back portion may be made to lie horizontally across the top of a pool. The pool cover described by Mishke is a relatively complicated and complex apparatus having multiple hinged members for accomplishing its purpose.

Another such device is disclosed in U.S. Pat. No. 2,912,703 to Murphy. Murphy shows a roof that is attached to four vertical posts for providing sun shade. The bottom ends of two of the posts are pivotally secured to the inside wall of an in-ground swimming pool while the two rearward posts are detachably connected to the ground. When the rear posts are detached from the ground, the roof may be rotated about the front post down to ground level whereupon it covers the swimming pool. Murphy thus is another example of a relatively complex and expensive apparatus for accomplishing its purpose.

SUMMARY OF THE INVENTION

Briefly, an embodiment of the invention contemplates a cover for covering pools having a flat surface surrounding the pool or a coping elevated a predetermined height above the surface area surrounding the pool. The cover includes a pair of spaced apart hinges mounted to a rigid support adjacent the pool. A hinge arm is pivotally mounted in each hinge for pivoting between open and cover pool positions about a pivot axis defined in the respective hinges. Each of the arms is capable of rotation through a predetermined angle from a plane that is substantially normal to the pivot axis. The hinge includes a clamp that has an axis oriented at a predetermined clamp angle relative to an axis of the arm.

A rigid planar hoop having a perimetral shape conforming to and circumscribing the pool is secured in the clamps. A panel spanning the area defined within the hoop is secured to the hoop. A resilient seal is attached to one side of the panel adjacent the edge thereof and forms a substantially air-tight seal with the panel such that when the panel covers the pool, the resilient seal contacts the area surrounding the pool for providing a substantially air-tight seal between the pool and the region enclosed by the cover.

Preferably, the clamp angle and the angle of rotation of said hinge arm in combination allow for adjustment of the hoop in the clamp in accordance with the shape of the hoop and the presence and elevation of the pool coping such that when the panel covers the pool, the hoop lies in a horizontal plane.

Preferably, the resilient seal comprises an inflated tube encased within a sleeve that is secured to the panel. In an alternate embodiment, the resilient seal may also be formed of a rubber or plastic foam type material and the seal may be bonded to the panel or laced to the hoop. Due to its resiliency, the seal deforms upon contact with the area surrounding the pool for forming a seal therewith.

Preferably, the panel is formed from weatherproof fabric such as nylon and polyester reinforced nylon coated fabric. Preferably, the panel includes drainage means comprising a grommet located substantially in the center of the panel. The grommet has an aperture that extends through the panel for conducting water accumulating on the panel into the pool.

Preferably, the cover includes a lock for locking the hoop in place while in the cover pool mode.

DETAILED DESCRIPTION

Figure 1:
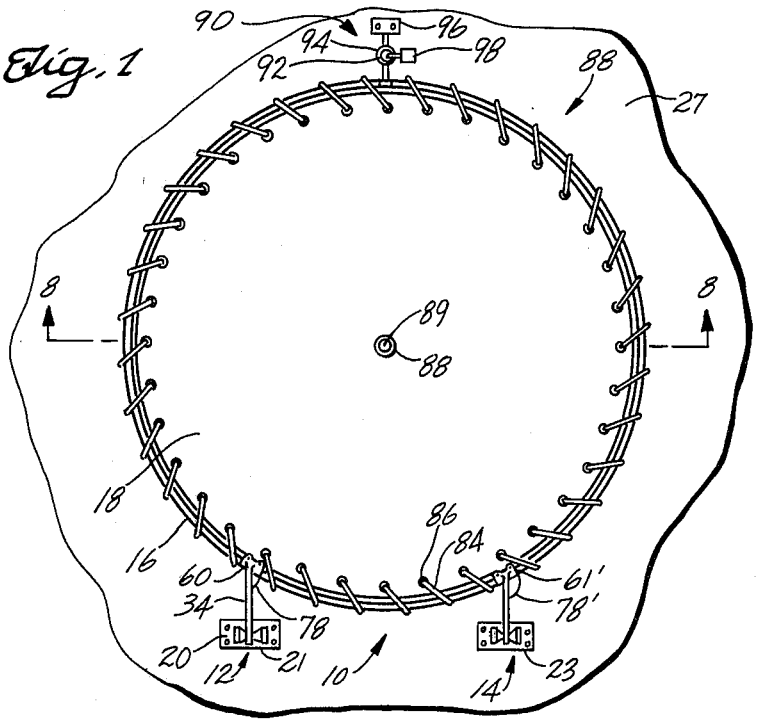
FIG. 1 is a top view showing the pool cover in the cover pool mode.

Consider as an exemplary embodiment of the present invention the adjustable pool cover generally depicted by the numeral 10 of FIG. 1, and hereinafter referred to as cover 10. The cover 10 depicted in FIG. 1 is shown in the position covering a pool. It is to be noted and understood that pool is used synonymously with hot tub, jacuzzi and the like.

The cover 10 includes a pair of spaced apart hinges 12 and 14, a hoop 16 secured to the hinges and a panel 18 that is secured to the hoop. A thin sheet of insulating material 11 such as closed-cell polyethelyene foam for heat insulation is secured to the underside of panel 18. The insulation layer provides for heat retention in the pool as well as affording protection to the water in the pool against the effects of climate and sun exposure.

To be later explained in more detail, the underside of cover 10 also includes a perimetral resilient seal 19 that may be secured to the insulation layer 11 or in an alternate embodiment attached to the hoop 16 by conventional lacing techniques.

The panel 18 is pivotable about a pivot axis 17 (defined in hinges 12 and 14) from an open to a pool cover mode. Although not always the case, a pool has an edge or coping that circumscribes the water containing portion of the pool, forming thereby a boundary between the pool and the surface area surrounding the pool. Conventional pools have a pool coping that may extend above the surface area surrounding the pool as much as about 6 inches. The present invention provides a cover 10 that is adjustable in hinges 12 and 14 such that in the pool cover mode, the panel 18 is adjusted to lie in a horizontal plane and the plane contacts the pool coping for providing an essentially air-tight seal between the panel and the water in the pool. Such arrangement also inhibits the "bottoming out" of the hoop 16 against the surface area surrounding the pool.

Figure 2:
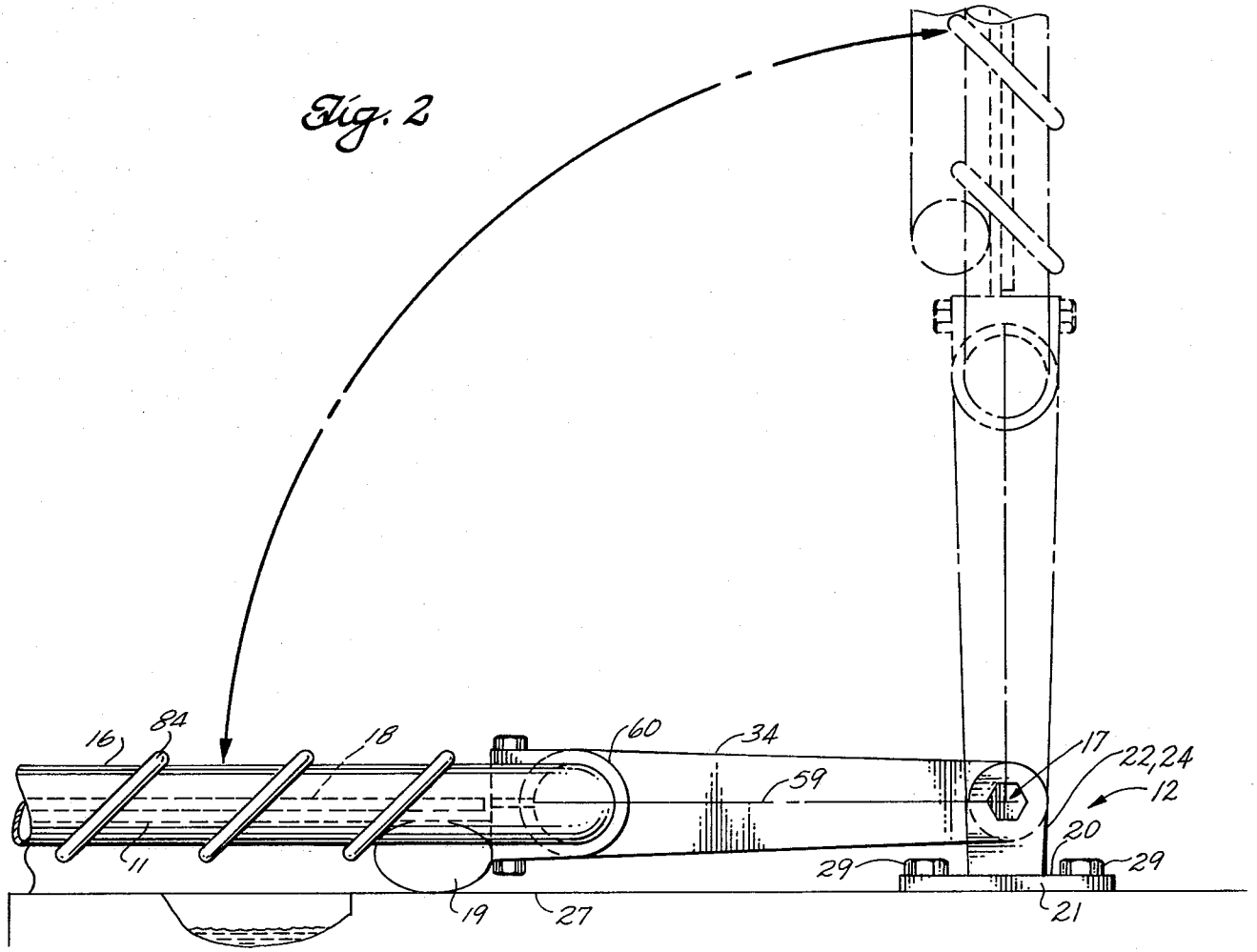
FIG. 2 is a partial side elevation view showing a hoop secured in a clamp for covering a pool having a flat surface surrounding a pool partially broken away to show the water in the pool. The panel is shown in phantom.
Figure 3:
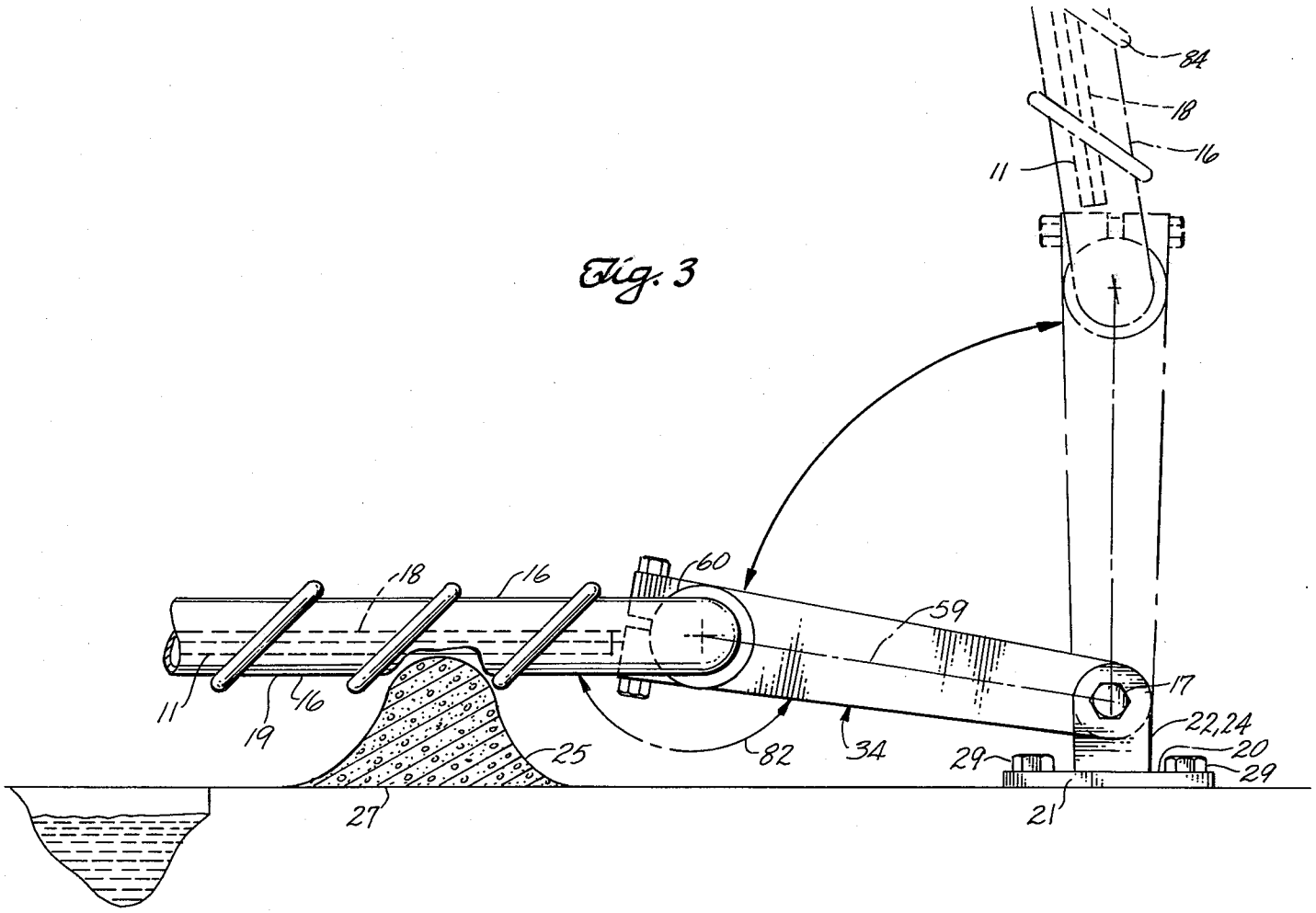
FIG. 3 is a partial side elevation view similar to FIG. 2 but showing a hoop secured in a hinge for covering a pool having a pool coping extending above the surface area surrounding the pool, the size of the coping shown in cross section is exaggerated for purposes of illustration.

FIG. 2 illustrates the panel 18 adjusted in the hinge 12 (hinge 14 is not shown) for covering a pool not including a pool coping, whereas FIG. 3 illustrates the panel 18 adjusted in the hinge 12 for covering a pool that has a pool coping 25 extending above the area 27 surrounding the pool. As shown in FIGS. 2 and 3, the hoop 16 is capable of pivoting in hinge 12 about the pivot axis 17 from an open to pool cover mode. In the case of a circular hoop, the diameter thereof may range typically from about 4 to 9 feet. Preferably, the hoop 16 is formed of hollow tubing such as steel, aluminum, stainless steel and the like as well as PVC or extruded plastic tubing. The tubing may range from about ½ inch to 2 inches in diameter, and may be formed of a number of individual sections interconnectable by any one of a number of conventional techniques. One such technique contemplates one end of a hoop section being crimped for insertion into an uncrimped end of an adjacent hoop section for easy assembly of the hoop during installation of the cover 10. The hoops formed of metal may be coated with a vinyl nylon or polyester material for purposes of appearance and protection. Although a circular hoop is illustrated in FIG. 1, it is to be understood that the hoop may be provided with octagonal, oval, square or other geometric shapes.

Figure 4:
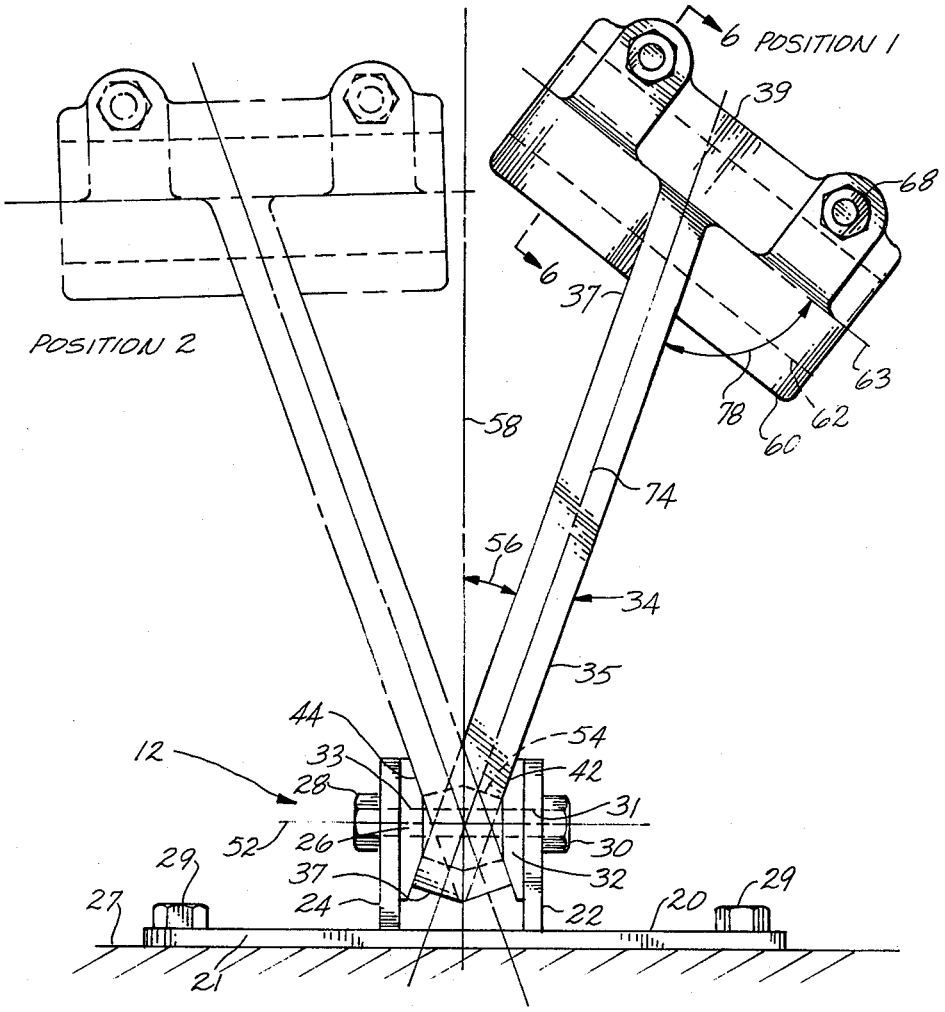
FIG. 4 is a front elevation view of a hinge arm mounted for pivotal movement in the hinge. The hinge arm shown in phantom is the position representing the maximum angle of rotation through which the hinge arm is capable of rotating in the hinge.

In the preferred embodiment and as illustrated in FIG. 4, the hinges 12 and 14 include a mounting base 20, two upstanding parallel flanges 22 and 24 located on the base, a pin 26 secured in the flanges by means of mounting nuts 28 and 30, a grommet 32 mounted axially on pin 26 and a hinge arm 34 adapted for both pivotal and rotational movement on the grommet 32. The hinge 12 is secured to the surface 27 by means of securing bolts 29. The flanges 22 and 24 have a coaxial bore 31 and 33 respectively adapted for receiving the pin 26. Preferably, the hinges 12 and 14 are formed of metal such as steel or aluminum.

Figure 5:
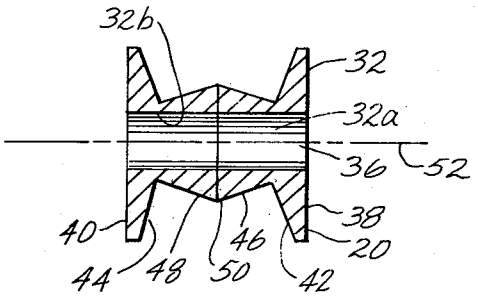
FIG. 5 is a cross-sectional view of two abutting portions of a hinge grommet.

The grommet 32 shown in cross section in FIG. 5. The grommet 32 is formed of two individual identical segments **32*a* and 32*b* shown to the right and left (as viewed in FIG. 5) respectively of annular apex 50. The grommet 32 is in the general shape of a spool having a central bore 36 sized marginally than larger pin 26 for receiving said pin 26 and a pair of parallel spaced apart outside walls 38 and 40 for placement between and in contact with the inwardly facing walls of the respective flanges 22 and 24. The grommet 32 also has inside annular walls 42 and 44 that are inclined preferably about 20 degrees relative to the grommet's outside walls. An annular central portion of the grommet defined between the inside walls 42 and 44 has sloping surfaces 46 and 48 that intersect walls 42 and 44 respectively at right angles. When grommet sections 36*a* and 36*b* are in abutting relation, the surfaces 46 and 48 intersect and form thereby an annular apex depicted at 50. Preferably, the surfaces 46 and 48 are at a 20 degree angle relative to the grommet axis 52. Preferably, the grommet 32** is formed of durable frictionless material such as nylon.

Referring again to FIG. 4, there is shown a hinge arm 34 mounted for pivoting in the hinge 12. The hinge arm 34 has a central portion 35, a lower portion 37 that has a cylindrical bore 54 to provide for pivoting about pin 26, and an upper portion 39 that forms hinge clamp 60. Although not essential to the invention, the central portion 35 is formed preferably of bar stock having a rectangular cross section. Suitable materials for the hinge arm 34 include, for example, steel and lightweight aluminum. The hinge arm bore 54 is slightly larger than the diameter of the grommet annular central portion defined at apex 50. Thus, in addition to being capable of pivoting, the hinge arm 34 is capable of rotation through a predetermined angle 56 from a plane 58 that is coplanar with apex 50 and normal to the pivot axis 17 and thus the grommet axis 52. Since plane 58 is coplanar with apex 50, the plane 58 lies at a location intermediate the grommet central bore 36. Preferably, the predetermined angle 56 is about 20 degrees and therefore the hinge arm 34 is capable of rotation through an angle of rotation of 40 degrees. The limits of such rotation are indicated between position 1 and position 2 of FIG. 4.

As shown in FIG. 4, the limits of rotation of the hinge arm 34 between positions 1 and 2 is defined by the points of contact of the hinge arm 34 with the grommet walls 42 and 44. At position 1, for example, the hinge arm 34 at a station just above the bore 54 contacts grommet wall 42, whereas at a station just below the bore 54, the hinge arm 34 contacts grommet wall 44. Conversely, at position 2, the hinge arm 34 at a station just above the bore 54 contacts grommet wall 44, whereas at a station just below the bore 54, the hinge arm 34 contacts grommet wall 42.

Figure 6:
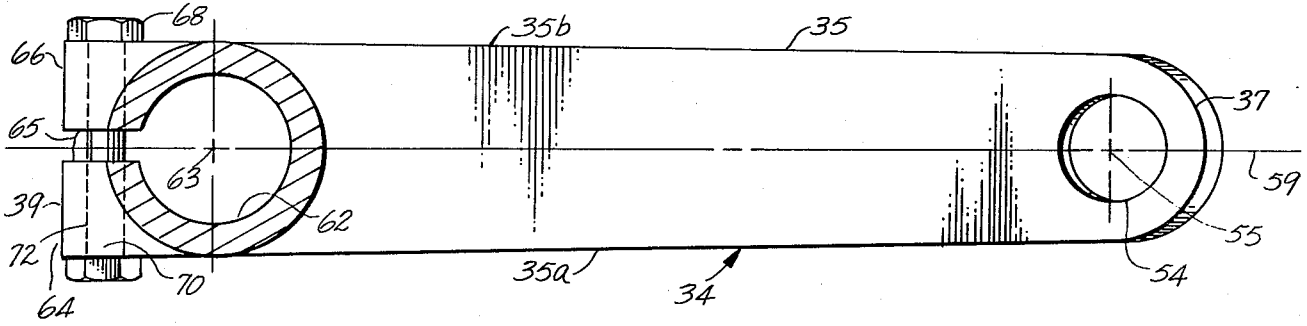
FIG. 6 is a side elevation perspective view of a hinge arm.

As better shown in FIG. 6, the lamp 60 has a cylindrical bore 62 within which the hoop 16 is clamped. The axis 63 of bore 62 and the axis 55 of bore 54 lie in a plane depicted at 59 that bisects hinge arm 34. The clamp 60 is split into two segments 64 and 66 defining a spacing 65 therebetween for permitting the segments to be drawn together for gripping the hoop 16 within the clamp. The segments 64 and 66 are drawn together by means of tightening a conventional nut and bolt arrangement that is depicted at 68 and 70 respectively. The bolt 70 is located in a bore 72 provided near the outer edge of clamp 60. The hinge arm 34 has a lengthwise axis 74 (see FIG. 4) that is at a predetermined clamp angle 78 with the axis 63. Preferably, the clamp angle is about 80 degrees.

The foregoing description relates to hinge 14 as well as hinge 12 except that for hinge 14, the clamp angle depicted at 78′ (see FIG. 1) is preferably about 110 degrees. But virtue of the clamp angles 78 and 78′, the hinges 12 and 14 respectively may be arranged as a spaced apart pair for securement to a hoop 16 as shown in FIG. 1. More specifically, the hinges 12 and 14 are arranged such that the hinge with the clamp angle being less than 90 degrees is placed to the immediate right (as viewed in FIG. 1) of the hinge with the clamp angle being greater than 90 degrees. With such arrangement, each of the clamps 60 and 60′ of hinges 12 and 14 respectively is capable of securement to hoop 16 having various sizes and shapes along the perimeter thereof, while providing for pivoting the hoop from an open to a pool cover mode without hinge binding or jamming.

For round hoops and by virtue of the 40 degree rotational capability, the hinges 12 and 14 may be secured to hoops having diameters ranging from about 4 feet to about 9 feet.

Figure 7A:
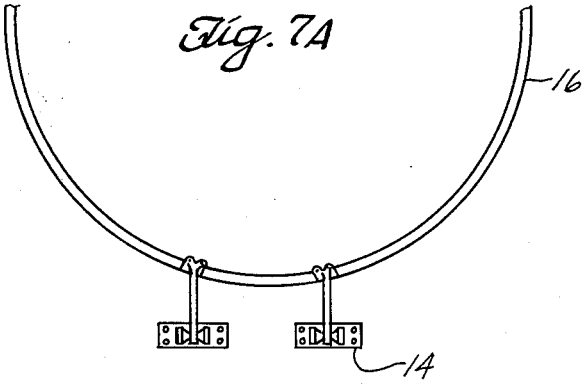
FIGS. 7A and 7B are partial top views of the pool cover mounting hoops having different diameters, the diameter of the hoop of FIG. 7A being smaller than the hoop of FIG. 7B.
Figure 7B:
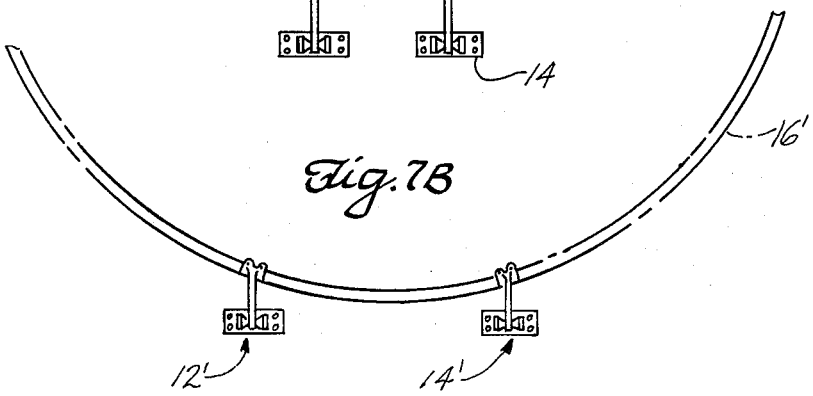

Thus, for a four-foot diameter hoop, the hinge arm clamps 60 and 60′ would be positioned relatively closer together on the hoop perimeter, whereas, for the nine-foot diameter hoop, the clamps would be positioned relatively further apart. FIGS. 7A and 7B illustrate such clamp placement on two hoops where the hoop 16 has a smaller diameter than that of 16′. It is to be understood that the invention is not to be construed as being limited to the aforementioned hoop diameters, but that the hinges may also be suitably adapted for accommodating a much wider range of hoop sizes.

Another important aspect of the hinge arrangement is in the ability to provide closure of a hoop 16 on a pool that has a coping 25 that circumscribes the pool.

Referring again to FIG. 2, a hoop 16 is mounted in the hinge arm clamps for a pool not having a coping. In such case, the hoop 16 is coplanar with the hinge arm plane depicted at 59. Accordingly, the clamps 60 and 60′ are spaced apart on the hoop 16 according to the diameter of the hoop. FIG. 3 illustrates the mounting of a hoop 16 for covering a pool having a coping 25 extending above the surface surrounding the pool. Accordingly, the hoop 16 is secured in the clamps 60 and 60′ such that the plane defined by the hoop 16 is at a predetermined angle 82 with respect the hinge arm plane depicted at 59. For the example illustrated where the coping 25 extends about 6 inches above the area surrounding the pool, the predetermined angle 82 is about 135 degrees.

The predetermined angle 82 is set at the time of installation of the pool cover. More specifically, for the case of a raised coping, the hoop 16 having the clamps 60 and 60′ mounted thereon is placed over the pool. The hinge arms are swung downwards until the respective mounting bases 20 contacts the support surface to which the hinges are rigidly mounted.

As shown in FIG. 1, the mounting base 20 is generally rectangular, and the clamps are adjusted in position on the hoop such that the sides 21 and 23 of hinges 12 and 14 respectively are coplanar. In such position, the clamps are fixedly secured to the hoop, and the hinges are rigidly mounted to the support surface 27. Preferably, the hinges are bolted to the support surface 27 by conventional techniques, using, for example, bolts 29. With the foregoing described hinge arrangement, the hoop 16 will pivot from fully open to a cover pool mode without hinge jamming or binding. Additionally, the hoop will lie across the top of the pool at the uppermost portion of coping 82 in a horizontal plane.

Figure 8:
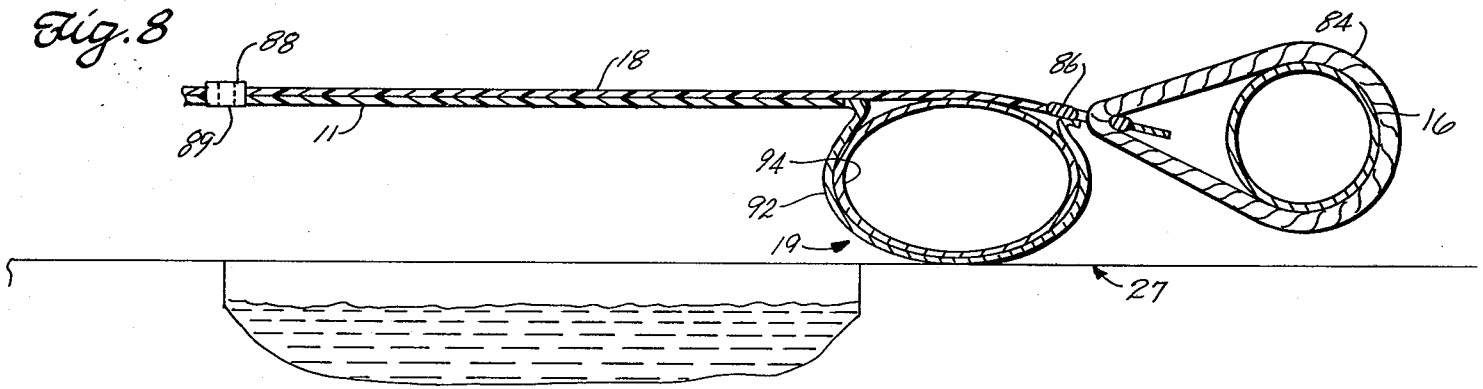
FIG. 8 is an exploded partial side elevation cross-sectional view of the panel with a resilient seal in contact with the area surrounding a pool not having a coping. The area surrounding the pool is partially broken away to show the water in the pool.

Referring again to FIG. 1 and FIG. 8, there is shown a panel 18 mounted to the hoop 16 by means of a lacing 84 that is wrapped in a helical fashion around the hoop 16 and sequentially through equally spaced panel eyelets 86. The panel 18 conforms to the contour of the perimeter of the hoop 16 and is somewhat smaller than the hoop so as to be spaced uniformly about ½ inch away from such perimeter. The panel 18 is laced so as to be taut. The lacing 84 may be formed from any one of a number of conventional materials such as nylon. Preferably, the panel 18 is formed of a nylon or polyester reinforced nylon coated fabric.

A grommet 88 having an aperture 89 is located in the center of the panel 18. The aperture 89, a conduit for water that has accumulated on the upper surface of the panel 18 to pass into the pool. The water may be from such sources as rain and morning dew.

The resilient seal 19 can be secured to the lower surface of the panel 18 or detachably mounted to the hoop 16 at a predetermined location inward from the perimeter of the panel. Preferably, the location of the seal 19 provides sufficient area along the edge of the panel 18 for placement of the eyelets 86. The seal 19 is sized so that in the pool cover mode, the seal is in contact with the area 27 surrounding the pool.

By virtue of the air friction encountered by the panel 18 and the seal 19 as the hoop 16 descends to the cover pool mode, the hoop will glide down to the pool with an essentially slow and dampened motion. Consequently, the panel 18 comes into contact with the pool at a relatively slow rate of speed preventing damage to either the pool or the pool cover.

Except for the grommet aperture 89, the seal 19 also provides a substantially air-tight seal between the panel 18 and the water in the pool. This prevents any substantial evaporation of the water in the pool when the pool is covered as well as preventing water contamination due to for example, leaves, dust, insects and other debris likely to enter an uncovered pool.

The seal 19 includes a sleeve 92 that is secured to the panel 18. The sleeve is formed preferably of a vinyl material that is secured to the panel by any one of a number of conventional techniques such as provided by heat seam bonding. An inflated tube 94 is located within the sleeve and has a cross sectional area that is somewhat less than that of the sleeve. The sleeve 92 and tube 94 are resilient and thus provide the resiliency characterizing the seal 19. Contact of the seal 19 with the surface 27 or coping 25 causes the seal to deform slightly, that is, flatten somewhat against the surface 27 or coping 25 forming thereby the substantially air-tight seal therebetween.

Figure 9:
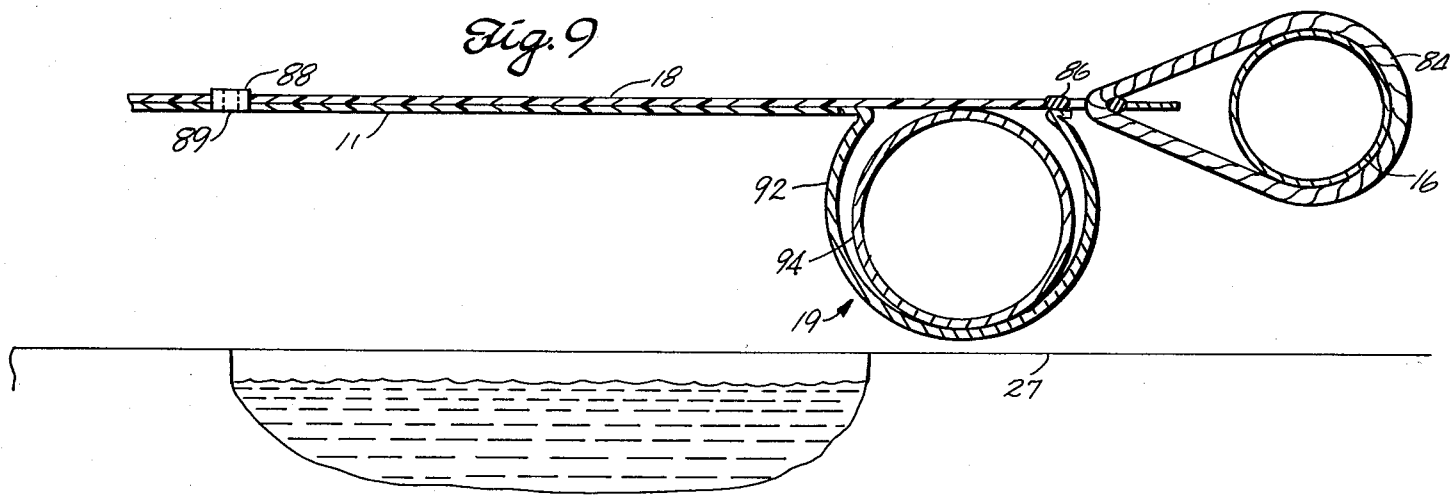
FIG. 9 is a view according to FIG. 8 with the seal out of contact with the area surrounding the pool.

The tube 94 preferably has a circular cross section, and as shown in FIG. 9, the tube returns to such circular cross section when the panel is removed from contact with the pool. It is to be understood that the seal 19 is not limited to the foregoing described prefered embodiment, but may vary and be formed of other resilient materials, such as for example, closed-cell neoprene and the like.

Figure 10:
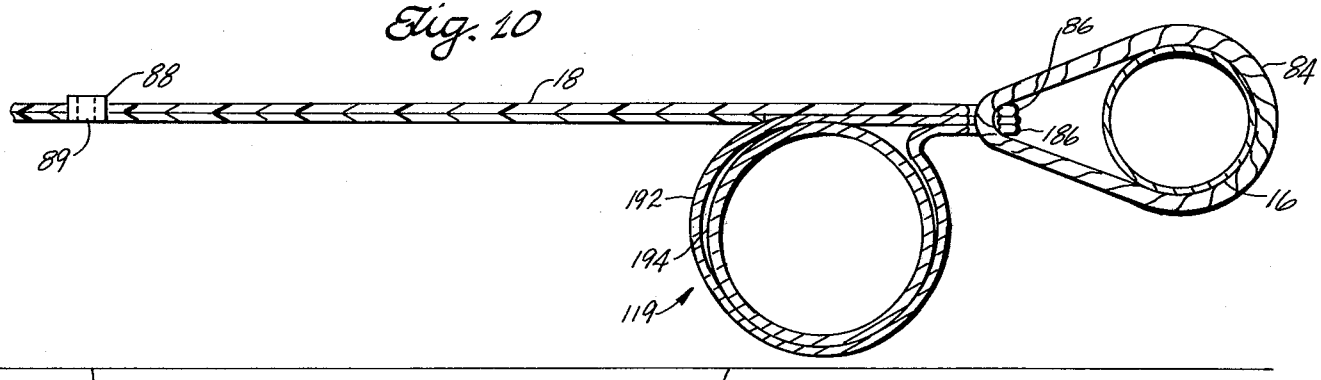
FIG. 10 is a partial view according to FIG. 8 with a detachable resilient seal.
Figure 11:
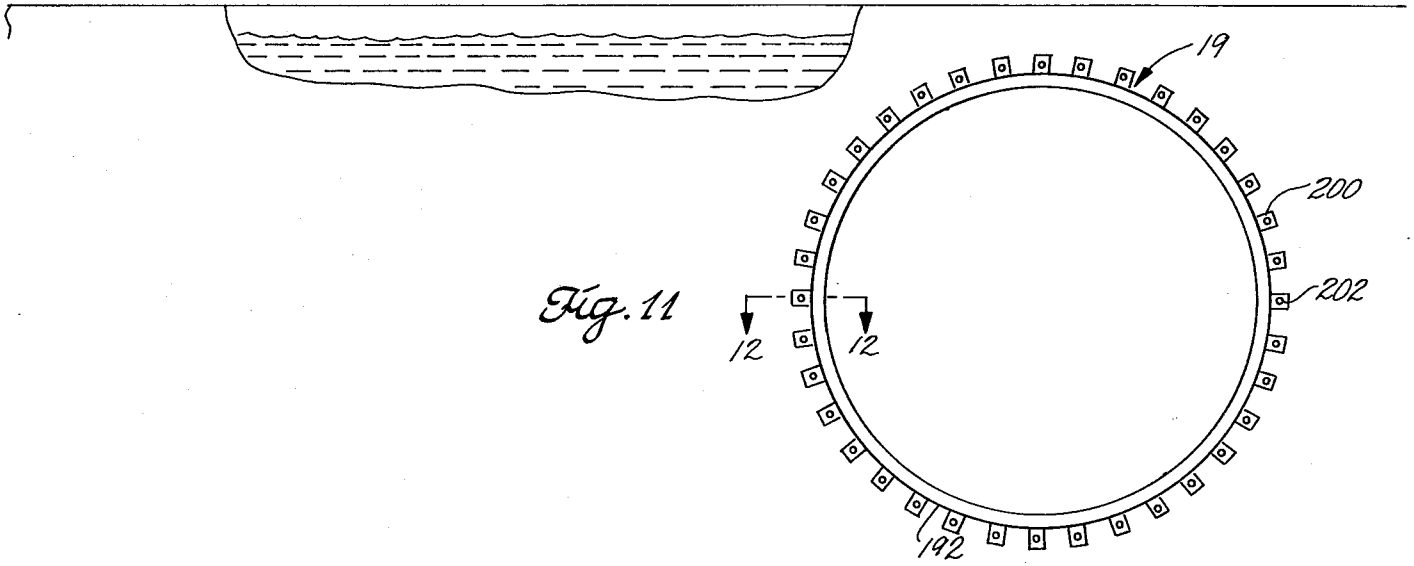
FIG. 11 is a top view of an alternate embodiment of a resilient seal.

An alternate embodiment of the resilient seal 119 is shown in FIGS. 10 and 11. Sleeve 192 is a hollow structure the encases an inflated tube 194. The sleeve conforms to the shape of the hoop 16 and has a plurality of spaced apart outwardly pointing tabs 200. The tabs have an eyelet 202 and the tabs are spaced such that the eyelets 202 are capable of registration with corresponding cover eyelets 86.

The resilient seal 119 is secured to the hoop 16 along with panel 18 by means of lacing 84 that is wrapped in a helical fashion around the hoop 16 and sequentially through the eyelets 86 and 202.

Figure 12:
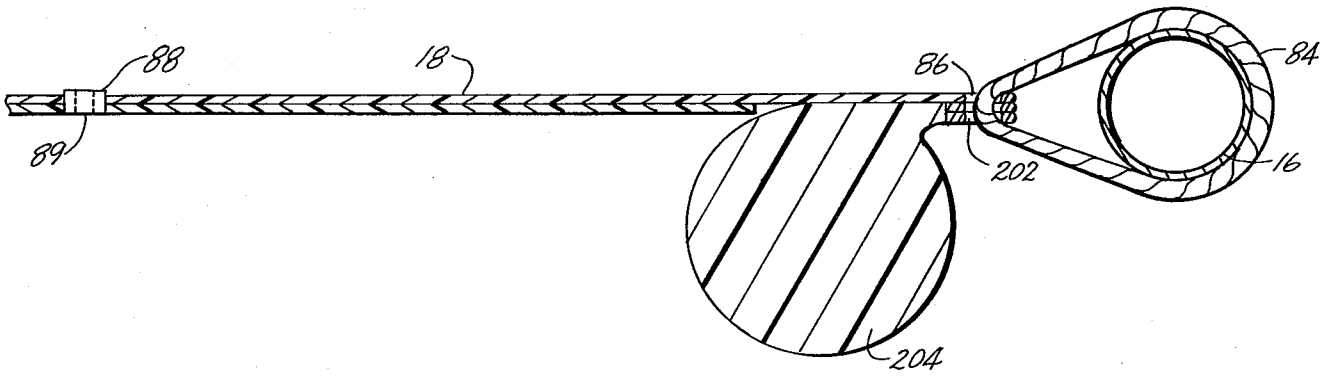
FIG. 12 is a partial cross-sectional view of an alternate embodiment of the resilient seal taken along line 12—12 of FIG. 11.

The invention also contemplates other methods of securement of the panel and the resilient seal to the hoop such as, for example, by the use of snap fasteners and the like. Additionally, as shown in partial cross section in FIG. 12, the invention also contemplates that the resilient seal 204 may be formed of a solid unitary piece of flexible material such as rubber, plastic foam-type material and the like.

The cover 10 may also be provided with a conventional locking arrangement such as depicted at 90 in FIG. 1. The locking arrangement 90 may include a ring 92 secured to the hoop 16 and ring 94 rigidly mounted to surface 27 by means of a ring mounting base 96. A conventional lock 98 may be used to interlock rings 92 and 94 so as to lock the hoop 16 in the pool cover mode. Such locking capability provides the obvious safety features necessary when small children may be in the proximity of the pool.

Although the invention has been shown and described with respect to a preferred embodiment thereof, it should be understood by those skilled in the art that various changes and omissions in the form and detail thereof may be made without departing from the spirit and scope of this invention. For example, the hinges 12 and 14 may be secured to the sides of an above-ground, free-standing pool. Thus, the hinge arms need not be as long as the sides of the pool or be provided with any additional structure but be of the form described herein.

What is claimed is:

1. A cover for covering pools comprising:

at least one hinge for mounting to a rigid support adjacent the pool;

a hinge arm pivotally mounted in such a hinge for pivoting between open and cover pool positions, the arm having an axis and first and second ends, the arm being pivotable at the first end thereof about a pivot axis defined in the hinge, the arm being capable of movement through a predetermined angle of rotation away from a plane that is substantially normal to the pivot axis;

a clamp at the second end of the arm, the clamp having an axis oriented at a predetermined clamp angle relative to the axis of the arm;

a hoop having a perimetral shape conforming to and circumscribing the pool, said hoop secured in the clamp, an interior hoop area being defined by the perimeter of the hoop; and a panel for covering the pool and secured to the hoop and spanning the interior hoop area thereof, the clamp angle and the angle of rotation of said hinge arm in combination allowing for adjustment of the hoop in the clamp in accordance with the shape of said hoop such that when the panel covers the pool the hoop lies in a horizontal plane.

2. The cover of claim 1 comprising a pair of said hinges spaced apart from one another, and a separate hinge arm pivotally mounted in each hinge, said hoop being secured in the clamps at the ends of the pair of arms.

3. The cover of claim 2 comprising a resilient seal located on one side of the panel adjacent the perimetral edge thereof and forming an air-tight seal therewith such that when the panel covers the pool the resilient seal contacts the area surrounding the pool and a substantially air-tight seal is provided between the pool and the region enclosed by the cover.

4. The cover of claim 3 wherein the resilient seal deforms upon contact with the area surrounding the pool for forming a seal therewith and wherein said resilient seal returns to its undeformed state upon removal of contact of the resilient seal with the area surrounding the pool.

5. The cover of claim 4 wherein the resilient seal is secured to the panel.

6. The cover of claim 4 wherein the resilient seal is detachably mounted to the hoop.

7. The cover of claim 4 wherein the resilient seal comprises an inflated tube encased within a hollow sleeve.

8. The cover of claim 4 wherein the resilient seal is formed of a solid unitary piece of flexible material.

9. The cover of claim 2 wherein each hinge comprises a substantially cylindrical hinge pin mounted therein, the hinge pin defining the pivot axis; and an annular generally spool shaped hinge grommet having an axial bore adapted for receiving the pin and being mounted thereon, said hinge grommet having annular inclined interior facing walls, said hinge arm being pivotable on the grommet, the hinge arm being capable of movement on the grommet such that contact of the hinge arm with the interior walls of the grommet defines the limits of the arc of rotation of the movement of the hinge arm in the hinge.

10. The cover of claim 9 wherein said inclined walls extend in opposite directions away from a plane that is located intermediate the hinge grommet axial bore and being normal thereto.

11. The cover of claim 1 wherein said panel is formed of nylon.

12. The cover of claim 1 wherein said panel is formed of polyester reinforced nylon coated fabric.

13. The cover of claim 1 comprising drainage means located in the panel for providing drainage for any water accumulating on the panel closed over the pool.

14. The cover of claim 13 wherein said drainage means comprises a grommet located substantially in the center of the panel, said grommet having an aperture that extends through the panel for conducting water accumulating on the panel into the pool.

15. The cover of claim 1 comprising means for locking said hoop in position while said panel is covering a pool.

16. The cover of claim 1 wherein said hoop is planar and rigid.

17. The cover of claim 1 wherein said pool has a coping being a predetermined height above the surface area surrounding the pool, the panel circumscribing the coping, the hoop being adjusted in the clamps in accordance with the height of the coping such that when the panel covers the pool, the panel lies on the upper extremities of the coping.

* * * * *